US008278626B2

(12) United States Patent
Murakami et al.

(10) Patent No.: US 8,278,626 B2
(45) Date of Patent: Oct. 2, 2012

(54) DEVICE FOR MASS SPECTROMETRY, AND MASS SPECTROMETRY APPARATUS AND METHOD

(75) Inventors: Naoki Murakami, Ashigarakami-gun (JP); Hisashi Ohtsuka, Ashigarakami-gun (JP); Morihito Ikeda, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 25 days.

(21) Appl. No.: 12/561,040

(22) Filed: Sep. 16, 2009

(65) Prior Publication Data

US 2010/0065735 A1 Mar. 18, 2010

(30) Foreign Application Priority Data

Sep. 17, 2008 (JP) ..... 2008-237681

(51) Int. Cl.
*H01J 27/24* (2006.01)
*H01J 49/16* (2006.01)

(52) U.S. Cl. ..... 250/425; 250/288

(58) Field of Classification Search ..... 250/288
See application file for complete search history.

(56) References Cited

U.S. PATENT DOCUMENTS 6,476,409 B2 11/2002 Iwasaki
6,610,463 B1 8/2003 Ohkura
7,700,914 B2 * 4/2010 Yoshimura et al. ..... 250/288
2004/0183176 A1 * 9/2004 Naya et al. ..... 257/680
2006/0157648 A1 7/2006 Siuzdak
2007/0158549 A1 * 7/2007 Naya et al. ..... 250/288
2008/0073512 A1 3/2008 Siuzdak
2008/0128608 A1 * 6/2008 Northen et al. ..... 250/282

FOREIGN PATENT DOCUMENTS

JP 9-320515 A 12/1997

OTHER PUBLICATIONS

H. Masuda, "Preparation of Mesoporus Alumina by Anodic Oxidization and its Application as Functional Material," Material Technology, 1997, pp. 341-346, vol. 15, No. 10.

T.R. Northen, et al., "Clathrate Nanostructures for Mass Spectrometry," Nature, 2007, p. 16 of Supplementary Information, pp. 1033-1037, vol. 449.

H. Wang, et al., "Nanosphere Arrays with Controlled Sub-10-nm Gaps as Surface-Enhanced Raman Spectroscopy Substrates," Journal Am. Chem. Soc., Oct. 8, 2005, pp. 14992-14993, vol. 127.

* cited by examiner

*Primary Examiner* — Jack Berman
*Assistant Examiner* — Eliza Osenbaugh-Stewart
(74) *Attorney, Agent, or Firm* — Sughrue Mion, PLLC

(57) ABSTRACT

In a device for mass spectrometry, an analyte contained in a sample is desorbed from a surface of the device by irradiating the sample in contact with the surface with measurement light. The device includes a micro-structure having a plurality of metal bodies on a surface of a substrate, and the plurality of metal bodies have sizes that can excite localized plasmons by irradiation with the measurement light. Further, the device includes an initiator fixed at least to a part of a surface of the micro-structure.

12 Claims, 6 Drawing Sheets

DEVICE FOR MASS SPECTROMETRY, AND MASS SPECTROMETRY APPARATUS AND METHOD

BACKGROUND OF THE INVENTION

1. Field of the Invention

The present invention relates to a device for mass spectrometry that is used in a method for performing mass spectrometry. In the method, a sample (assay material) in contact with a surface of the device is irradiated with measurement light, and an analyte (analysis target) for mass spectrometry contained in the sample is desorbed from the surface of the device to perform mass spectrometry on the analyte. Further, the present invention relates to a mass spectrometry apparatus and a mass spectrometry method using the device for mass spectrometry.

2. Description of the Related Art

Mass spectrometry methods are used to identify a substance or the like, and a mass spectrometry method in which an analyte is desorbed from a device for mass spectrometry by irradiating a sample in contact with the device with measurement light and the desorbed analyte is detected for each mass is well known. For example, in a time-of-flight mass spectrometry method (Time of Flight Mass Spectroscopy: TOF-MS), the mass of a substance desorbed from a device for mass spectrometry is analyzed based on flight time of the substance by making the substance fly for a predetermined distance.

Ordinarily, in the mass spectrometry methods as described above, the analyte is ionized and desorbed from the device for mass spectrometry. However, particularly when the analyte is a sparingly volatile substance (or non-volatile substance), such as a bio-substance obtained from a living body, or a high-molecular-weight substance, such as a synthetic polymer, the analyte is neither easily ionized nor desorbed. Therefore, various methods for performing mass spectrometry on these kinds of substance have been studied.

In a matrix assisted laser desorption ionization method (MALDI method), an analyte is mixed into sinapic acid, glycerine or the like, which is called as a matrix, to obtain a mixed crystal, and the mixed crystal is used as a sample. Further, light energy absorbed by the matrix is utilized to vaporize the analyte together with the matrix. Further, the analyte is ionized by proton-transfer (proton movement) between the matrix and the analyte. The MALDI method is widely used in mass spectrometry of a sparingly volatile substance, a bio-molecule, a high-molecular-weight substance, such as a synthetic polymer, and the like (for example, Japanese Unexamined Patent Publication No. 9(1997)-320515 or the like), because the MALDI method is a soft ionization method that causes neither extensive fragmentation nor chemical change (chemical effect), such as change in the properties of the analyte.

However, when the analyte is a synthetic polymer or the like, the solubility of the analyte with respect to a solvent, the polarity of the polymer chain of the analyte, and the like greatly differ according to a difference in the chemical structure of the polymer chain. Further, even if the structure of the main chain is the same, the properties of the analyte differ according to the average molecular weight, the chemical structure of a terminal group, or the like. Therefore, it is necessary to optimize the kind of a matrix material and the method for preparing the crystal based on the kind of the analyte.

Further, a surface-assisted laser desorption/ionization mass spectrometry (SALDI-MA) method is being studied. In the SALDI-MA method, the matrix material is not used.

Instead, a function for assisting desorption and ionization of the analyte is provided in the device for mass spectrometry per se to perform soft ionization. For example, the specification of U.S. Patent Application Publication No. 20080073512 and the specification of U.S. Patent Application Publication No. 20060157648 disclose a device for mass spectrometry using a porous silicon substrate having nano-order porous structure on the surface of the substrate. In the device, the interaction between the silicon nano-structure and the measurement light is utilized to perform soft ionization.

However, the degree of enhancement of the ion detection efficiency by the SALDI-MS method is not sufficient. Therefore, in mass spectrometry of a sparingly volatile substance and a high-molecular-weight substance, it is necessary to use high-power measurement light. Therefore, problems, such as fragmentation or change in the properties of the analyte, and deformation of the substrate per se, remain.

SUMMARY OF THE INVENTION

In view of the foregoing circumstances, it is an object of the present invention to provide a device for mass spectrometry that can lower the power of the measurement light in the surface-assisted laser desorption/ionization mass spectrometry (SALDI-MA) method. Further, the device for mass spectrometry can perform mass spectrometry on a sparingly volatile substance and a high-molecular-weight substance without causing fragmentation and change in the properties of the analyte, and deformation of the substrate per se. Further, it is another object of the present invention to provide a mass spectrometry apparatus including the device and a mass spectrometry method using the device.

A device for mass spectrometry of the present invention is a device for mass spectrometry, wherein a sample in contact with a surface of the device is irradiated with measurement light to desorb an analyte contained in the sample from the surface of the device, the device comprising:

a micro-structure including a substrate and a plurality of metal bodies on a surface of the substrate, the plurality of metal bodies having sizes that can excite localized plasmons by irradiation with the measurement light; and an initiator fixed at least to a part of a surface of the micro-structure.

According to a first embodiment of the device for mass spectrometry of the present invention, the substrate in the micro-structure includes a dielectric having a plurality of micro-pores that have openings on the surface of the substrate and bottoms, and the plurality of metal bodies are fixed at least to a part of the bottoms of the plurality of micro-pores and/or at least to a part of a non-opening portion of the surface of the substrate, in which the micro-pores are not present.

According to a second embodiment of the device for mass spectrometry of the present invention, the substrate in the micro-structure includes a dielectric having a plurality of micro-pores that have openings on the surface of the substrate and bottoms, and the plurality of metal bodies include filling portions that fill the insides of the plurality of micro-pores and projection portions that are formed on the filling projection in such a manner to project from the surface of the substrate. The maximum diameters of the projection portions in a direction parallel to the surface of the substrate are greater than the diameters of the filling portions. Further, at least a part of the projection portions of the plurality of metal bodies are apart from each other. In this embodiment, it is desirable that an average distance between the projection portions that are next to each other is 10 nm or less.

Further, in the first and second embodiments of the present invention, it is desirable that the distribution of the plurality of micro-pores are substantially regular. Further, it is desirable that the dielectric is made of a metal oxide object obtained by anodically oxidizing a part of a metal body to be anodically oxidized, and that the plurality of micro-pores were formed in the metal oxide object during the process of anodically oxidizing the part of the metal body to be anodically oxidized.

In a device for mass spectrometry according to the present invention, it is desirable that the initiator is an organic silicon compound.

A mass spectrometry apparatus according to the present invention is a mass spectrometry apparatus comprising:

a device for mass spectrometry of the present invention;

a light irradiation means that irradiates the sample in contact with a surface of the device for mass spectrometry, the surface on which the initiator has been fixed, to desorb the analyte of mass spectrometry contained in the sample from the surface of the device for mass spectrometry; and an analysis means that analyzes the mass of the analyte by detecting the desorbed analyte. According to an embodiment of the present invention, the mass spectrometry apparatus of the present invention is a time-of-flight mass spectrometry apparatus.

A mass spectrometry method of the present invention is a mass spectrometry method using a device for mass spectrometry of the present invention, the method comprising the steps of:

making the sample in contact with a surface of the device for mass spectrometry, the surface on which the initiator has been fixed;

irradiating the sample in contact with the surface with measurement light;

enhancing the effect of the initiator by a localized plasmon enhanced electric field generated in the plurality of metal bodies by irradiation with the measurement light and by the measurement light enhanced in the localized plasmon enhanced electric field to desorb the analyte contained in the sample from the surface of the device for mass spectrometry; and analyzing the mass of the analyte by capturing the analyte desorbed from the surface.

Here, the term "the effect of the initiator" means an effect of promoting ionization of an analyte by giving ions or energy to the analyte by irradiation of the initiator with measurement light.

A device for mass spectrometry of the present invention includes a micro-structure having a substrate and a plurality of metal bodies on a surface of the substrate, and the plurality of metal bodies have sizes that can excite localized plasmons by irradiation with measurement light. Further, the device for mass spectrometry of the present invention includes an initiator fixed at least to a part of a surface of the micro-structure. In the device for mass spectrometry that is structured as described above, localized plasmon enhanced electric field is induced on the sample contact surface of the device for mass spectrometry by irradiation with measurement light, and the analyte is efficiently ionized by the localized plasmon enhanced electric field and the initiator. Further, it is possible to efficiently desorb the analyte from the surface of the device for mass spectrometry. Further, in the electric field that has been enhanced by the localized plasmon, the excitation efficiency of the initiator is increased as well as the energy of the measurement light. Therefore, the synergy of these two enhancement effects can effectively improve the ionization efficiency and the absolute intensity of detected signals. Therefore, according to the present invention, it is possible to lower the power of the measurement light even if mass spectrometry is performed by using the surface-assisted laser desorption/ionization mass spectrometry (SALDI-MA) method. Further, even if the analyte is a sparingly volatile substance or a high-molecular-weight substance, mass spectrometry can be performed on the analyte at high sensitivity without causing problems, such as fragmentation or change in the properties of the analyte, and deformation of the substrate per se.

DESCRIPTION OF THE PREFERRED EMBODIMENTS

First Embodiment of Device for Mass Spectrometry

Figure 1A:
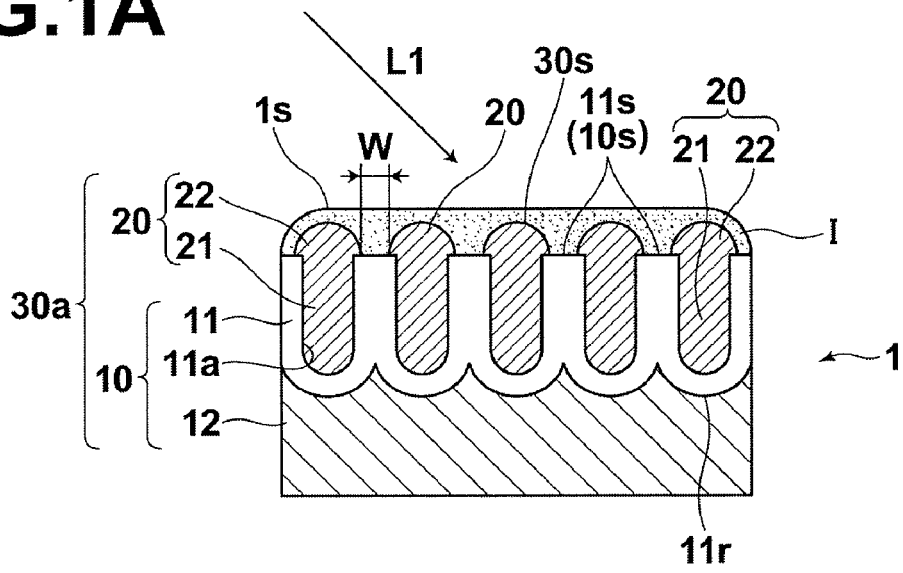
FIG. 1A is a sectional view of a device for mass spectrometry according to a first embodiment of the present invention in the thickness direction of the device.
Figure 1B:
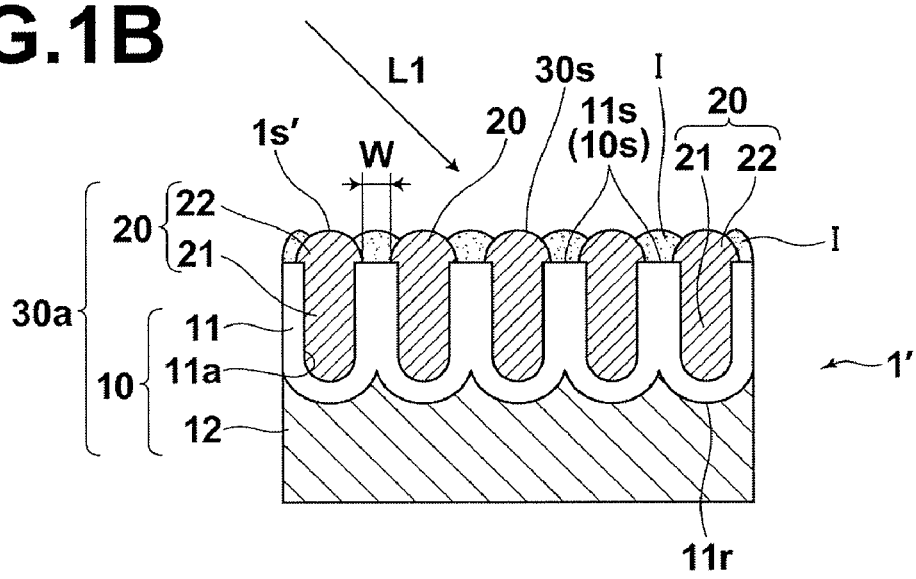
FIG. 1B is a sectional view of a device for mass spectrometry according to another example of the first embodiment of the present invention in the thickness direction of the device.

With reference to FIGS. 1A and 1B, a device for mass spectrometry (mass spectroscopy) according to a first embodiment of the present invention will be described. FIGS. 1A and 1B are sectional views of the device for mass spectrometry in the thickness direction of the device. FIGS. 2A through 2E are diagrams illustrating the process of producing the device. In FIGS. 1A, 1B and 2A through 2E, the elements of the device are appropriately illustrated in different scales from actual elements so that they are easily recognized.

As illustrated in FIGS. 1A and 1B, a device 1 (1') for mass spectrometry of the present embodiment desorbs an analyte, which is a target of mass spectrometry contained in a sample, from a surface 1*s* of the device by irradiating the sample in contact with the surface 1*s* with measurement light L1. The device 1 (1') for mass spectrometry of the present embodiment includes a micro-structure 30*a* and an initiator (ionization promotion agent) I. The micro-structure 30*a* includes a substrate 10 and a plurality of metal bodies 20 provided on a surface 10*s* of the substrate 10. The plurality of metal bodies 20 have sizes that can excite localized plasmons by irradiation with the measurement light L1. Further, the initiator I is fixed at least to a part of a surface 30*s* of the micro-structure 30*a*.

In the present embodiment, the device 1 (1') for mass spectrometry includes a substrate 10 and a plurality of metal bodies (micro metal bodies) 20. The substrate 10 includes an electroconductor (electrical conductor) 12 and a dielectric 11 formed on the electroconductor 12. Further, a multiplicity of micro-pores 11*a* that have openings on a surface 11*s* of the dielectric 11 are formed in the dielectric 11. The multiplicity of micro-pores 11*a* have substantially the same form when viewed in a plane view direction, and are substantially regularly arranged. The plurality of metal bodies 20 include filling portions 21 and projection portions 22. The filling portions 21 fill the multiplicity of micro-pores 11*a*. The projection portions 22 are formed on the micro-pores 11*a* in such a manner that they project from the surface 11*s* (10*s*) of the micro-pores 11*a*. Further, the maximum diameter of each of the projection portions 22 in a direction parallel to the surface is greater than the diameter of the filling portion 21, and the projection portions 22 have diameters (sizes) that can excite localized plasmons. The plurality of projection portions 22 are fixed in such a manner that at least a part of the projection portions 22 are apart from each other.

In the device 1 (1') for mass spectrometry, the micro-pores 11*a* extend substantially straight from the surface 11*s* in the thickness direction of the dielectric 11. Further, the micro-pores 11*a* are non-through-holes, which have openings that do not reach back side 11*r* of the dielectric 11.

In the present embodiment, as illustrated in FIGS. 2A through 2E, the dielectric 11 is an alumina ($Al_2O_3$) layer (metal oxide layer) 41 obtained by anodically oxidizing a part of a metal body 40 to be anodically oxidized. The metal body 40 to be anodically oxidized contains aluminum (Al) as a main component. The metal body 40 to be anodically oxidized may contain a minute amount of impurities. Further, the electroconductor 12 is constituted of a non-anodically-oxidized portion 42 of the metal body 40 to be anodically oxidized. The non-anodically-oxidized portion 42 is a portion that has not been anodically oxidized.

The form of the metal body 40 to be anodically oxidized is not limited. The metal body 40 to be anodically oxidized may have plate form. Alternatively, the metal body 40 to be anodically oxidized may be provided by being attached to a support member, for example, by being deposited on the support member to form a layer or layers.

In anodic oxidization, for example, the metal body 40 to be anodically oxidized is used as an anode (positive electrode) and carbon, aluminum or the like is used as a cathode (negative electrode, counter electrode). The anode and the cathode are impregnated with an electrolyte solution for anodic oxidization, and voltage is applied between the anode and the cathode to perform anodic oxidization. The electrolyte solution is not limited. However, it is desirable to use an acid electrolyte solution containing one kind of acid or at least two kinds of acids selected from the group consisting of sulfuric acid, phosphoric acid, chromic acid, oxalic acid, sulfamic acid, benzenesulfonic acid and the like.

Figure 2A:
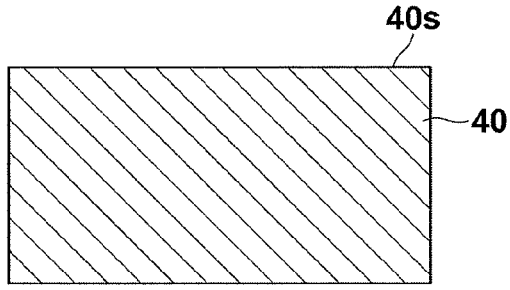
FIG. 2A is a sectional view illustrating the process of producing the device for mass spectrometry illustrated in FIG. 1A.
Figure 2B:
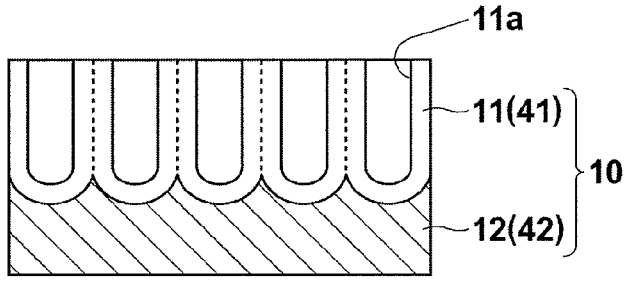
FIG. 2B is a sectional view illustrating the process of producing the device for mass spectrometry illustrated in FIG. 1A.

When the metal body 40 to be anodically oxidized, illustrated in FIG. 2A, is anodically oxidized, oxidization progresses, as illustrated in FIG. 2B. The oxidization progresses from a surface 40*s* (upper surface in FIG. 2B) of the metal body 40 to be anodically oxidized in a direction substantially perpendicular to the surface 40*s*, and an alumina layer 41 (11) is formed.

The alumina layer 41 (11) formed by anodic oxidization has structure in which micro prism bodies that have substantially equilateral hexagon form when viewed in a plane view direction are arranged next to each other. Further, a micro-pore 11*a* is formed substantially at a center of each of the micro prism bodies from the surface 40*s* in the depth direction of the metal body 40 to be anodically oxidized. Further, the bottom of each of the micro-pores 11*a* and the micro prism bodies are rounded, as illustrated in FIG. 2B. Further, the structure of an alumina layer produced by anodic oxidization is described in "Preparation of Mesoporous Alumina by Anodic Oxidization and its Application as Functional Material", H. Masuda, Material Technology, Vol. 15, No. 10, pp. 341-346, 1997, and the like.

The condition of anodic oxidization should be appropriately designed in such a manner that a non-anodically-oxidized portion remains and that the micro-pores 11*a* are deep enough to prevent the micro metal bodies 20 from easily dropping (being separated) from the alumina layer 11 (dielectric). When oxalic acid is used as the acid electrolyte solution, a desirable condition is, for example, the density of the electrolyte solution at 0.5 M, the temperature of the liquid at 15° C., and applied voltage at 40 V. It is possible to obtain the alumina layer 41 (11) that has an arbitrary thickness by changing the time period of electrolysis. If the thickness of the metal body 40 to be anodically oxidized before anodic oxidization is thicker than the thickness of an alumina layer 41 (11) to be produced by anodic oxidization, the non-anodically-oxidized portion remains. Therefore, it is possible to obtain the alumina layer 41 (dielectric) (11) provided on an electroconductor 42 (12) constituted of the non-anodically-oxidized portion. The alumina layer 41 has a multiplicity of micro-pores 11*a* that have substantially the same form when viewed in a plane view direction. The micro-pores 11*a* have openings at the surface 11*s*, and they are substantially regularly arranged.

Further, the diameter of each of the micro-pores and the pitch (pitch of arrangement) between the micro-pores that are next to each other may be controlled by adjusting the anodic oxidization condition. It is desirable that the diameter and the pitch are less than the wavelength of the measurement light L1. Ordinarily, the pitch of the micro-pores 11*a* next to each other can be controlled in the range of 10 to 500 nm. Further, the diameter of the micro-pore can be controlled in the range of 5 to 400 nm. U.S. Pat. Nos. 6,476,409 and 6,610,463 disclose methods for more precisely controlling formation positions of the micro-pores and the diameters of the micro-pores. These methods can be used to form the micro-pores that are substantially regularly arranged and that have arbitrary diameters and depths within the aforementioned ranges.

Next, the micro metal body 20 including the filling portion 21 and the projection portion 22 is formed in each of the micro-pores 11*a* in the substrate 10. Accordingly, the micro-structure 30*a* is formed. The micro metal bodies 20 are formed by performing electroplating or the like on the micro pores 11*a* of the dielectric 11.

Figure 2C:
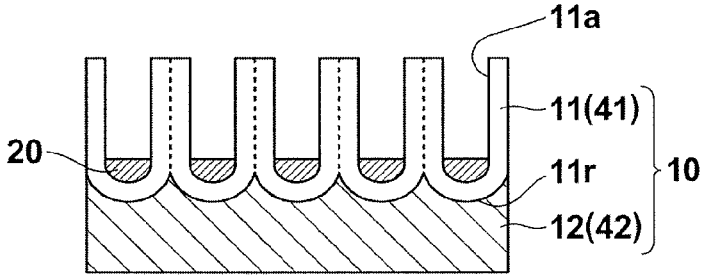
FIG. 2C is a sectional view illustrating the process of producing the device for mass spectrometry illustrated in FIG. 1A.
Figure 2D:
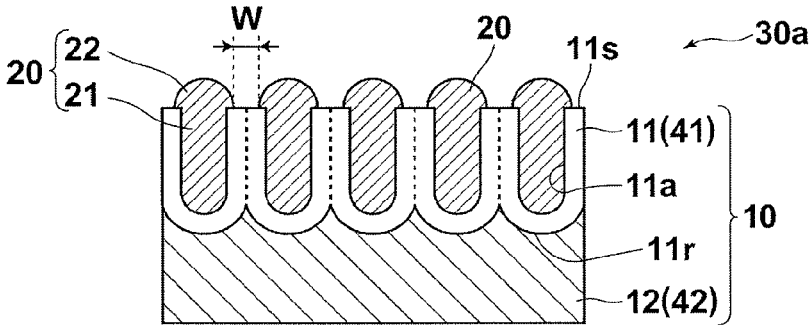
FIG. 2D is a sectional view illustrating the process of producing the device for mass spectrometry illustrated in FIG. 1A.

When electroplating is performed, the dielectric 12 functions as an electrode, and metal precipitates dominantly from the bottom of the micro-pore 11*a* at which the electric field is strong (FIG. 2C). When electroplating is continued, the micro pore 11*a* is filled with the metal, and the filling portion 21 of the micro metal body 20 is formed. After the filling portion 21 is formed, if electroplating is continued, the metal flows over from the micro-pore 11*a*. Since the electric field in the vicinity of the micro-pore 11*a* is strong, the metal continues to precipitate in the vicinity of the micro-pore 11*a*, and a projection portion 22 is formed on the filling portion 21. The projection portion 22 projects from the surface 11*s*, and the diameter of the projection portion 22 is greater than the diameter of the filling portion 21. Accordingly, the micro-structure 30*a* is obtained (FIG. 2D).

The sizes of the micro metal bodies 20 are not limited as long as the projection portions 22 have sizes that can excite localized plasmons. However, it is desirable that the maximum size (diameter) of the projection portions 22 is less than the wavelength of the measurement light L. When the wavelength of the measurement light L1 (incident light) is considered, it is desirable that the maximum size (diameter) of the projection portions 22 is greater than or equal to 10 nm and less than or equal to 300 nm.

In the micro-structure 30*a*, it is desirable that the projection portions 22 next to each other are apart from each other, and that an average distance w between the projection portions is in the range of a few nm to 10 nm. When the average distance w is in the aforementioned range, a region called as a hot spot, in which the electric field enhancement effect by localized plasmons is extremely high, is generated in the vicinity of the projection portions 22, and that is desirable.

The localized plasmon phenomenon generates a strong electric field in the vicinity of projection portions by vibration of free electrons in the projection portions that resonate with an optical field. Therefore, the micro metal bodies 20 may be made of an arbitrary metal including free electrons, such as Au, Ag, Cu, Pt, Ni and Ti. Further, a metal, such as Au and Ag, that has a high electric field enhancement effect may optionally be used.

In the present embodiment, the micro pores 11*a* are non-through holes, which do not reach the back side 11*r* of the dielectric. Further, the filling portions 21 of the micro metal bodies 20 fill the insides of the micro pores 11*a*. Therefore, the micro metal bodies 20 and the electroconductor 12 are not in contact with each other.

Figure 2E:
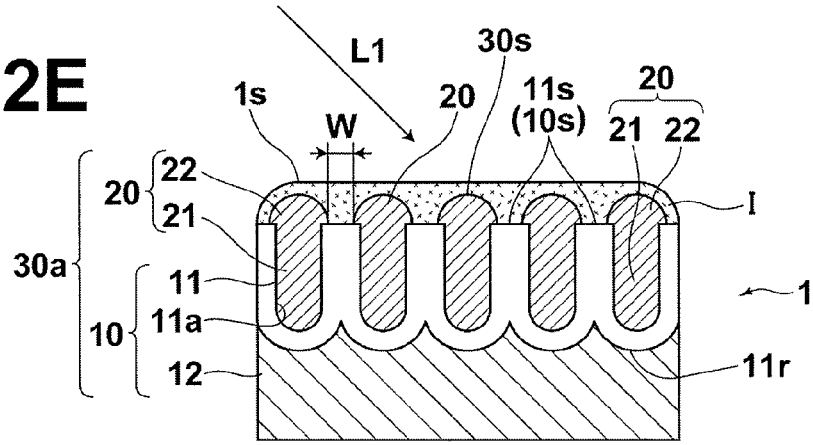
FIG. 2E is a sectional view illustrating the process of producing the device for mass spectrometry illustrated in FIG. 1A.

Next, initiator I is fixed at least to a part of the surface 30*s* of the micro-structure 30*a* to obtain the device 1 for mass spectrometry (FIG. 2E). The method for fixing the initiator I is not particularly limited. For example, the initiator I may be fixed by applying an appropriate amount of solution containing the initiator I to the surface 30*s*, and by removing a solvent from the applied solution by heating using an oven or the like. After heating, excessive initiator I may be blown away (removed) by using an air gun or the like to prevent the excessive initiator I remains on the surface 30*a*. After the excessive initiator I is removed, heating process and the like should be repeated.

The amount of the initiator I fixed onto the surface 30*a* is not particularly limited. However, when an excessive amount of initiator I is fixed, it becomes impossible to allow a sufficient amount of measurement light L1 reach the micro metal bodies 20 to excite localized plasmons in the micro metal bodies 20. Further, the excessive amount of initiator I is desorbed at the time of measurement, and the sensitivity of detection becomes lower. Further, if the amount of the initiator I is too small, it becomes impossible to effectively ionize the analyte. In the present embodiment, it is desirable that the initiator I is fixed at least to a part of gaps (space) between the micro metal bodies 20 next to each other.

The initiator I promotes ionization of the analyte by supplying ions or energy to the analyte by irradiation with the measurement light L1. The initiator I is not particularly limited as long as it has the aforementioned function. However, it is desirable that the initiator I does not generate an interfering peak, which reduces the sensitivity of detecting the analyte S. When the analyte S is a bio-molecule, a synthetic polymer, or the like, an organic silicon compound, such as bis(tridecafluoro-1,1,2,2-tetrahydrooctyl)tetramethyl-disiloxan, 1,3-dioctyltetramethyldisiloxan, 1,3-bis(hydroxybutyl)tetramethyldisiloxan, and 1,3-bis(3-carboxypropyl) tetramethyldisiloxan, described in "Clathrate Nanostructures for Mass Spectrometry", T. R. Northen et al., Nature, p. 16 of Supplementary Information, Vol. 449, pp. 1033-1037, 2007, may be used. Alternatively, a carbon nanotube, a substrate (ground substance, matrix), a fullerene or the like may be used as the initiator I.

Further, a matrix material, such as nicotinic acid, picolinic acid, 3-hydroxypicolinic acid, 3-aminopicolinic acid, 2,5-dihydroxybenzonic acid, α-cyano-4-hydroxycinnamic acid, sinapic acid, 2-(4-hydroxyphenylazo)benzonic acid, 2-mercaptobenzothiazole, 5-chloro-2-mercaptobenzothiazole, 2,6-dihydroxyacetophenone, 2,4,6-trihydroxyacetophenone, dithranol, benzo[a]pyrene, 9-nitroanthracene, and 2-[(2E)-3-(4-tret-butylphenyl)-2-methylprop-2-enyliden]malononitrile, which is used in the MALDI method may be used as the initiator I.

The initiator I may be one kind of compound. Alternatively, a mixture of two or more kinds of compounds or a layered material of two or more kinds of compounds may be used as the initiator I.

As described above, the device 1 (1') for mass spectrometry includes the micro-structure 30*a* and the initiator I fixed at least to a part of the surface 30*s* of the micro-structure 30*a*. The micro-structure 30*a* includes the plurality of metal bodies 20 the surface 10*s* of the substrate 10. The plurality of metal bodies 20 have sizes that can excite localized plasmons by irradiation of with the measurement light L1. When the sample containing the analyte S is placed in contact with the sample-contact surface (surface) is of the device 1 (1') for mass spectrometry, and the sample is irradiated with the measurement light L1, localized plasmons are excited in the plurality of micro metal bodies 20, and an enhanced electric field is generated on the surface of the plurality of micro metal bodies 20. At the same time, the initiator I is excited. Further, energy from the measurement light L1 that has been increased in the enhanced electric field and protons, ions, energy or the like from the initiator I are supplied to the analyte to ionize the analyte S at high efficiency. Further, the analyte S can be desorbed from the surface 1*s*. The enhanced electric field by the localized plasmons can improve the excitation efficiency of the initiator I as well as the energy of the measurement light L1. Therefore, the synergy of the improved excitation efficiency of the initiator I and the higher-energy measurement light L1 can effectively enhance the ionization efficiency and the absolute strength (value) of the detected signal. Therefore, according to the device 1 (1') for mass spectrometry, it is possible to lower the power of the measurement light L1 in the surface-assisted laser desorption/ionization mass spectrometry (SALDI-MA) method. Further, even if the analyte S is a sparingly volatile substance or a high-molecular-weight substance, it is possible to perform mass spectrometry at high sensitivity without causing fragmentation or change in the properties of the analyte S and deformation of the substrate per se.

In the device 1 (1') for mass spectrometry, at least a part of the initiator I is exposed to the top surface of the device. Therefore, a function other than the ionization promotion function may be added to the surface of the device. For example, a substance that can chemically bind with the analyte S and that can ionize/desorb the analyte S by being decomposed by irradiation with the measurement light L1 may be used. When the analyte S is an antigen, if a functional group that is easily ionized and that can bind to an antibody that specifically binds to the antigen is exposed on the surface of the initiator I, the initiator I and the analyte S can bind to each other through the antibody. Therefore, it is possible to increase the density of the analyte S on the sample-contact surface is of the device. Hence, it is possible to improve the sensitivity of detection.

Further, the enhanced electric field by localized plasmons attenuates exponentially as the distance from the sample-contact surface 1*s* increases. Therefore, if mass spectrometry is performed in a state in which the analyte S is captured on the surface 1*s* through the antibody, the degree of enhancement of the energy of the measurement light L1 that directly irradiates the analyte S located relatively away from the enhanced electric field generation surface becomes lower. Therefore, it is possible to more effectively suppress fragmentation of the analyte S, and highly accurate mass spectrometry is possible.

As described in the section "Description of the Related Art", conventionally, it was necessary to adopt the MALDI method to perform mass spectrometry on a sparingly volatile substance or a high-molecular-weight substance without chemically affecting the analyte S. However, since the chemical structure of these substances is complex (complicated), it was essential to optimize, based on the chemical properties of the analyte, the method for preparing a mixed crystal of the matrix (matrix material) and the sample, and the process was always complicated. However, as described above, according to the device for mass spectrometry of the present embodiment, it is possible to perform mass spectrometry on the sparingly volatile substance or the high-molecular-weight substance by using the surface-assisted laser desorption/ionization mass spectrometry (SALDI-MA) method without causing fragmentation or change in the properties of the analyte S and deformation of the substrate per se. In the surface-assisted laser desorption/ionization mass spectrometry method, the sample can be prepared only by applying a sample solution to the sample-contact surface of the device for mass spectrometry. Therefore, in the present invention, it is possible to perform high-sensitivity mass spectrometry on the sparingly volatile substance or the high-molecular-weight substance by using a simple method without causing fragmentation or change in the properties of the analyte S and deformation of the substrate per se.

Second Embodiment of Device for Mass Spectrometry

Figure 3A:
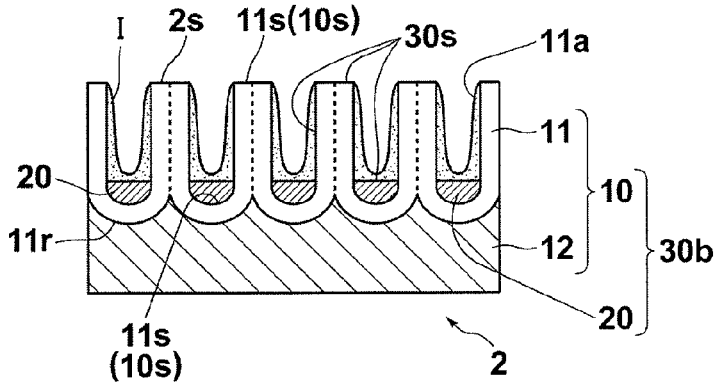
FIG. 3A is a sectional view of a device for mass spectrometry according to a second embodiment of the present invention in the thickness direction of the device.
Figure 3B:
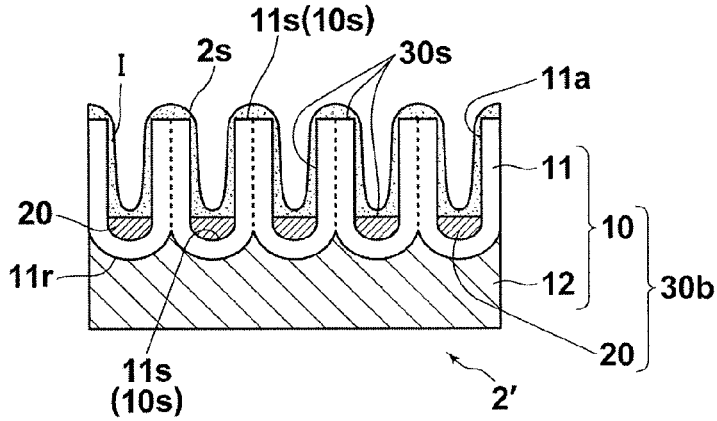
FIG. 3B is a sectional view of a device for mass spectrometry according to another example of the second embodiment of the present invention in the thickness direction of the device.

With reference to FIGS. 3A and 3B, a device 2 (2') for mass spectrometry according to a second embodiment of the present invention will be described. FIG. 3A is a sectional view of a device 2 for mass spectrometry in the thickness direction of the device. FIG. 3B is a sectional view of a device 2' for mass spectrometry in the thickness direction of the device. The elements of the device are appropriately illustrated in different scales from actual elements so that they are easily recognized.

As illustrated in FIGS. 3A and 3B, the device 2 (2') for mass spectrometry differs from the device 1 (1') for mass spectrometry according to the first embodiment in the manner of loading the micro metal bodies 20. Consequently, the manner of fixing the initiator I is also different from the first embodiment.

In the device 2 (2') for mass spectrometry, the micro-structure 30*b* includes a substrate 10 having a dielectric 11 formed on an electroconductor 12 in a manner similar to the first embodiment. In the dielectric 11, a multiplicity of micro pores 11*a* that have substantially the same form when viewed in plane view direction and that have openings on the surface 11*s* are substantially regularly arranged. Further, bottom portions of the plurality (multiplicity) of micro pores 11*a* are loaded with a plurality of micro metal bodies 20.

The substrate 10 is similar to the substrate of the first embodiment. Therefore, descriptions of desirable materials, form and production method of the substrate 10 will be omitted. Desirable materials of the initiator I are similar to the first embodiment.

The manner of loading (forming) the micro metal bodies 20 differs from the first embodiment. However, other desirable conditions are similar to the first embodiment.

Further, the method of loading the micro metal bodies 20 is similar to the first embodiment. Specifically, the micro metal bodies 20 are formed by performing electroplating or the like on the micro pores 11*a* in the dielectric 11. In the process of forming the micro-structure 30*b* of the present embodiment, deposition of the metal by plating or the like is stopped in the state illustrated in FIG. 2C. Further, ionization promotion I is fixed at least to a part of the surface 30*s* of the micro-structure 30*b* in a manner similar to the first embodiment to obtain the device 2 (2') for mass spectrometry (FIGS. 3A and 3B).

Alternatively, composition metal of the micro metal bodies 20 may be deposited from the upper surface of the micro-structure 30*b* onto the bottom portion of each of the micro pores 11*a*. The metal is deposited until micro metal bodies 20 having sizes that can excite localized plasmons are formed on the bottom portions of the micro pores 11*a*. After then, a layer of the composition metal of the micro metal bodies 20 that has been deposited on the surface 30*s* of the micro-structure 30*b* is removed to form the micro metal bodies 20 on the bottom portions of the micro pores 11*a*. Accordingly, it is possible to easily load the micro metal bodies 20. In this case, the method for forming the micro metal bodies 20 is not limited. For example, it is desirable that the micro metal bodies 20 are formed by using a vapor phase growth method, such as a vacuum evaporation (vapordeposition) method, a sputtering method, a CVD (chemical vapor deposition) method, a laser vapor deposition method, and a cluster ion beam method. The micro metal bodies 20 may be formed at a room temperature. Alternatively, the micro metal bodies 20 may be formed under heating. The formation temperature is not limited.

In the device 2 for mass spectrometry, illustrated in FIG. 3A, the initiator I is fixed only to the inside of the micro pores 11*a*. Alternatively, as illustrated in FIG. 3B, the initiator I may be fixed also to the surface 2*s* of the device 2' for mass spectrometry. Both of the device 2 for mass spectrometry and the device 2' for mass spectrometry can be produced by a method similar to the first embodiment. The device 2 for mass spectrometry, illustrated in FIG. 3A, can be produced by sufficiently removing the initiator I applied to the surface 2*s* so that the initiator I is fixed only to the inside of the micro pores 11*a*.

Further, when the sizes (diameters) of the openings of the micro pores 11*a* on the surface 2*s* are small, and a solution of initiator applied to the surface 2*s* does not enter the micro pores 11*a* by surface tension, and is present only on the surface 2*s*, the initiator I is fixed neither to the bottom portions of the micro pores 11*a* nor to the inside (inside walls) of the micro pores 11*a*. In other words, the initiator I may be fixed only to the surface 2*s*.

In the present embodiment, in a manner similar to the first embodiment, the device includes the micro-structure 30*b* including the plurality of metal bodies 20 formed on a surface of the substrate 10. The plurality of metal bodies 20 have sizes that can excite localized plasmons by irradiation with the measurement light L1. Further, the device includes the initiator I fixed at least to a part of the surface 30*s* of the micro-structure 30*b*. Therefore, it is possible to achieve an action and effect similar to the first embodiment.

Third Embodiment of Device for Mass Spectrometry

Figure 4A:
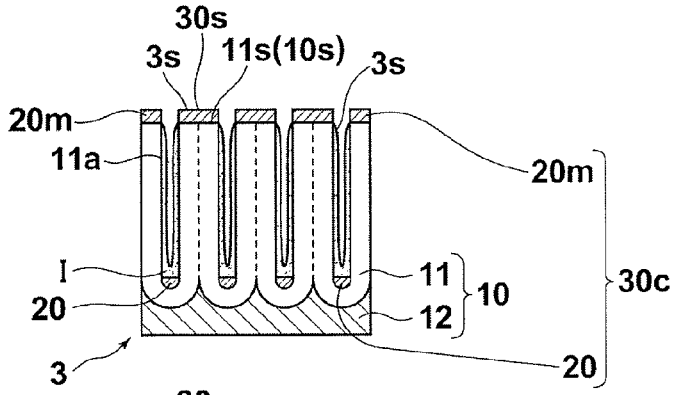
FIG. 4A is a sectional view of a device for mass spectrometry according to a third embodiment of the present invention in the thickness direction of the device.
Figure 4B:
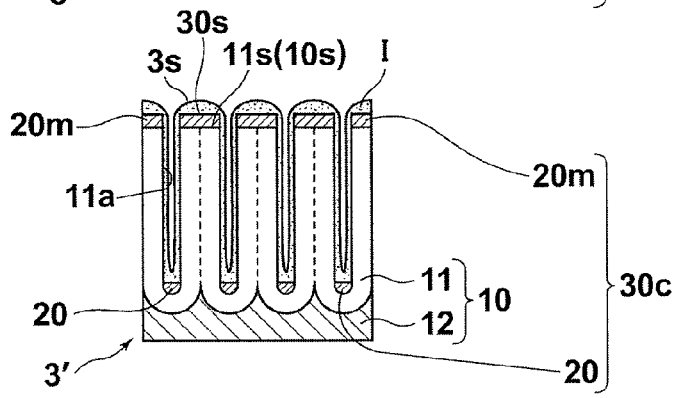
FIG. 4B is a sectional view of a device for mass spectrometry according to another example of the third embodiment of the present invention in the thickness direction of the device.

With reference to FIGS. 4A, 4B and 5A through 5E, a device 3 (3') for mass spectrometry according to a third embodiment of the present invention will be described. FIG. 4A is a sectional view of the device 3 for mass spectrometry in the thickness direction of the device. FIG. 4B is a sectional view of the device 3' for mass spectrometry in the thickness direction of the device. FIGS. 5A through 5E are diagrams illustrating the process of producing the device 3 for mass spectrometry. The elements of the device are appropriately illustrated in different scales from actual elements so that they are easily recognized.

As illustrated in FIGS. 4A and 4B, the device 3 (3') for mass spectrometry differs from the device 2 for mass spectrometry according to the second embodiment in that the device 3 (3') includes a metal layer (thin-film or coating) 20*m* on the surface 11*s* of the dielectric 11.

In the device 3 for mass spectrometry, the micro-structure 30*c* includes a substrate 10 having a dielectric 11 formed on an electroconductor 12 in a manner similar to the first embodiment. In the dielectric 11, a multiplicity of micro pores 11*a* that have substantially the same form when viewed in plane view direction and which have openings on the surface 11*s* are substantially regularly arranged. Further, bottom portions of the plurality (multiplicity) of micro pores 11 are loaded with a plurality of micro metal bodies 20 having sizes that can excite localized plasmons. Further, the metal layer 20*m* is deposited on the non-opening portions of the surface 11*s* of the dielectric, in which the micro pores 11*a* are not formed. The metal layer 20*m* is semi-transmissive and semi-reflective.

The substrate 10 is similar to the substrate of the first embodiment. Therefore, descriptions of desirable materials, form and production method of the substrate 10 will be omitted. Desirable materials of the initiator I are similar to the first embodiment.

Further, desirable sizes and material of the micro metal bodies 20 formed on the bottom portions of the micro pores 11*a* are similar to the first embodiment.

The thickness of the semi-transmissive/semi-reflective metal layer 20*m* deposited on the surface 11*s* of the dielectric 11 is not particularly limited. However, since the substrate 10 and the metal layer 20*m* form resonator structure, it is desirable that the thickness of the metal layer 20*m* can excite surface plasmons by total reflection light in the resonator to generate enhanced electric field on the metal layer 20*m* by surface plasmons. Further, the material of the metal layer 20*m* is not particularly limited. A desirable material for the metal layer 20*m* is similar to the material of the micro metal bodies 20.

Figure 5A:
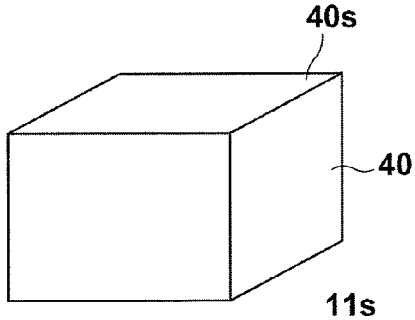
FIG. 5A is a sectional view illustrating the process of producing the device for mass spectrometry illustrated in FIG. 4A.
Figure 5B:
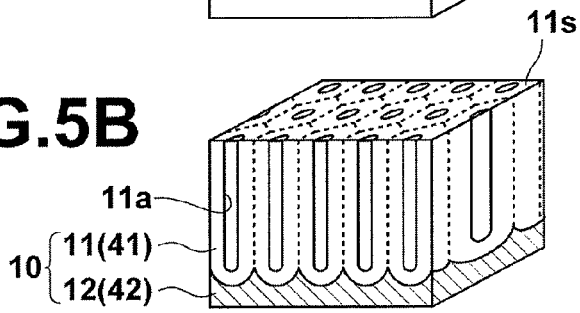
FIG. 5B is a sectional view illustrating the process of producing the device for mass spectrometry illustrated in FIG. 4A.

As illustrated in FIGS. 5A through 5E, in the device 3 for mass spectrometry of the present embodiment, the substrate 10 may be produced by using an anodic oxidization method similar to the first and second embodiments (FIGS. 5A and 5B).

Figure 5C:
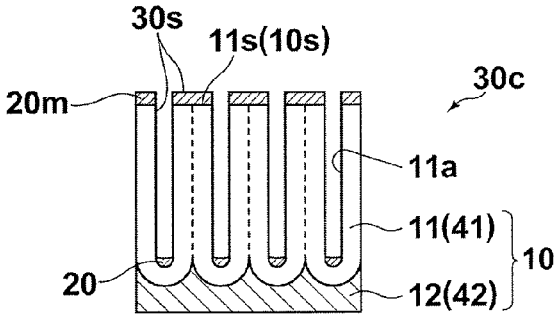
FIG. 5C is a sectional view illustrating the process of producing the device for mass spectrometry illustrated in FIG. 4A.

The method for forming the metal layer 20*m* and the method for forming the micro metal bodies 20 are not particularly limited. For example, it is desirable to use a vapor phase growth method, such as a vacuum evaporation method, a sputtering method, a CVD method, a laser vapor deposition method, and a cluster ion beam method. When the metal layer 20*m* is deposited from the upper surface of the surface 11*s* of the dielectric by the vapor phase growth method, the composition metal of the metal layer 20*m* is deposited also on the bottom of the micro pores 11*a*. Therefore, the micro metal bodies 20 and the metal layer 20*m* can be formed simultaneously (FIG. 5C). The micro metal bodies 20 and the metal layer 20*m* may be formed at a room temperature. Alternatively, the micro metal bodies 20 and the metal layer 20*m* may be formed under heating. The formation temperature is not limited.

Figure 5D:
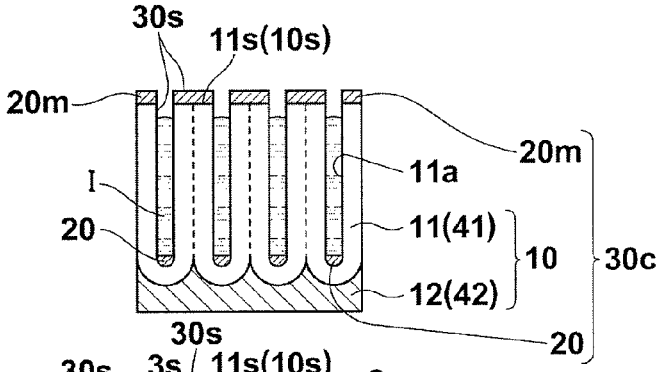
FIG. 5D is a sectional view illustrating the process of producing the device for mass spectrometry illustrated in FIG. 4A.
Figure 5E:
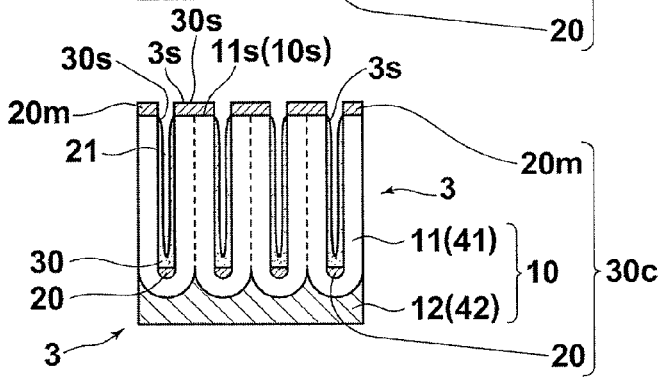
FIG. 5E is a sectional view illustrating the process of producing the device for mass spectrometry illustrated in FIG. 4A.

Next, the device 3 for mass spectrometry is obtained by fixing initiator I at least to a part of the surface 30*s* of the micro-structure 30*c*. The initiator I may be fixed in a manner similar to the first embodiment (FIGS. 5D and 5E).

In the device 3 for mass spectrometry, illustrated in FIG. 4A, the initiator I is fixed only to the inside of the micro pores 11*a*. Alternatively, as in the device 3' for mass spectrometry, illustrated in FIG. 4B, the initiator I may be fixed also to the surface 3*s* of the device 3' for mass spectrometry. Both of the device 3 for mass spectrometry and the device 3' for mass spectrometry can be produced by a method similar to the first embodiment. The device 3 for mass spectrometry, illustrated in FIG. 4A, can be produced by sufficiently removing the initiator I applied to the surface 3*s* so that the initiator I is fixed only to the inside of the micro pores 11*a*.

Further, when the sizes (diameters) of the openings of the micro pores 11*a* on the surface 3*s* are small, and a solution of initiator applied to the surface 3*s* does not enter the micro pores 11*a* by surface tension, and is present only on the surface 3*s*, the initiator I may be fixed neither to the bottom portions of the micro pores 11*a* nor to the inside of the micro pores 11*a*. In other words, the initiator I may be fixed only to the surface 3*s* in a manner similar to the second embodiment.

In the present embodiment, in a manner similar to the first embodiment, the device includes micro-structure 30*c* including the plurality of metal bodies 20 on a surface of the substrate 10. The plurality of metal bodies 20 have sizes that can excite localized plasmons by irradiation with the measurement light L1. Further, the device includes the initiator I fixed at least to a part of the surface 30*s* of the micro-structure 30*c*. Therefore, it is possible to achieve an action and effect similar to the first embodiment.

Further, in the present embodiment, when surface plasmons are excited in the metal layer 20*m*, it is possible to generate an enhanced electric field, the degree of enhancement of which is higher than the degree of enhancement by the micro metal bodies 20. Therefore, it is possible to further reduce the energy of the measurement light L1, and that is desirable.

In the aforementioned embodiment, a case in which in the micro-structure 30*c*, the metal layer 20*m* is provided in the non-opening portion of the surface 11*s* of the dielectric was described. Alternatively, micro metal bodies 20 having sizes that can excite localized plasmons may be fixed to the non-opening portion of the surface 11*s*. In such structure, it is possible to generate an enhanced electric field by localized plasmons at the non-opening portion of the surface 30*s* of the micro-structure 30*c*. In this case, it is desirable that the micro metal bodies 20 that are fixed to the surface 11*s* and next to each other are apart from each other. It is desirable that an average distance between the micro bodies 20 is in the range of a few nm to 10 nm. When the average distance is in the aforementioned range, it is possible to effectively obtain the electric field enhancement effect by localized plasmons.

The method for fixing the micro metal bodies 20 having sizes that can excite localized plasmons on the surface 11*s* is not particularly limited. For example, after the metal layer 20*m* is deposited on the non-opening portion of the surface 11*s*, in which the micro pores 11*a* are not formed (FIG. 5C), the metal, as the composition metal of the metal layer 20*m*, may be caused to cohere to form particles by thermal process. It can be considered that when the thickness of the metal layer 20*m* is in a nano order, the composition metal of the metal layer 20*m* melts once by the thermal process, and while the temperature drops, the melted metal naturally coheres to the surface 11*s* of the dielectric 11 to form the particles. The method of performing thermal process on the metal layer 20*m* is not limited. For example, the thermal process may be performed by annealing, such as laser annealing, electron beam annealing, flash lamp annealing, thermal radiation annealing using a heater, and electric furnace annealing.

The temperature of the thermal process is not limited as long as the composition metal of the metal layer 20*m* can cohere. It is desirable that the temperature is higher than or equal to the melting point of the metal layer 20*m* and less than the melting point of the dielectric 11. When the thickness of the metal layer 20*m* is in a nano order, so-called depression of the melting point, in which the metal melts at a temperature that is greatly lower than the melting point of the bulk metal of the metal, occurs. Therefore, if this phenomenon is utilized, the temperature of the thermal process can be set at a temperature that is higher than or equal to the melting point of the metal layer 20*m* and less than the melting point of the dielectric 11.

Besides the method of forming the micro metal bodies 20 by thermal processing after the metal layer 20*m* is formed on the surface 11*s*, a method, such as a method utilizing metal colloids, an LB (langmuir-Blodgett) method, a silane-coupling method, an oblique vapor deposition method, a vapor deposition method using a mask, and a method by natural evaporation after substituting CTAB for citric acid ("Nanosphere Arrays with Controlled Sub-10-nm Gaps as Surface-Enhanced Raman Spectroscopy Substrates", H. Wang et al., J. Am. Chem. Soc., Vol. 127, pp. 14992-14993, 2005), may be used.

Fourth Embodiment of Device for Mass Spectrometry

Figure 6:
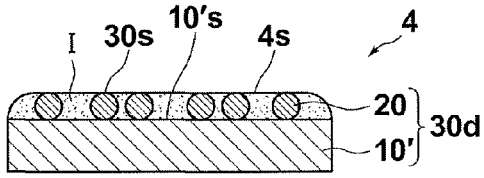
FIG. 6 is a sectional view of a device for mass spectrometry according to a fourth embodiment of the present invention in the thickness direction of the device.

With reference to FIG. 6, a device 4 for mass spectrometry according to a fourth embodiment of the present invention will be described. FIG. 6 is a sectional view of the device 4 for mass spectrometry in the thickness direction of the device. The elements of the device 4 are appropriately illustrated in different scales from actual elements so that they are easily recognized.

As illustrated in FIG. 6, the device 4 for mass spectrometry includes a micro-structure 30*d* having a substrate 10' and a plurality of micro metal bodies 20 formed on a surface 10'*s* of the substrate 10'. The sizes of the micro metal bodies 20 can excite localized plasmons. Further, the device 4 for mass spectrometry includes initiator I at least on a part of the surface 30*s* of the micro-structure 30*d*. The device 4 for mass spectrometry of the present embodiment differs from the devices for mass spectrometry in the first through third embodiments in that a plurality of metal bodies 20 are fixed onto a flat substrate 10' that has a substantially flat (smooth or even) surface.

The substrate 10' is not particularly limited. Various kinds of substrate (base plate), such as metal, semiconductor and dielectric, may be used as the substrate 10'. However, it is desirable that the substrate 10' is a dielectric substrate, because it is possible to effectively generate an enhanced electric field by localized plasmons in the micro metal bodies 20.

The micro metal bodies 20 have sizes that can excite localized plasmons in a manner similar to the first embodiment. Therefore, desirable material and sizes of the micro metal bodies 20 are similar to the first embodiment. Further, the desirable material of the initiator I is similar to the first embodiment.

The method for fixing the micro metal bodies 20 is not particularly limited. For example, after a solution containing the micro metal bodies 20 is applied to the surface of the substrate 10', the applied solution may be dried. Alternatively, a metal layer having a nano-order thickness may be deposited from the upper surface of the substrate 10' by using a vapor phase growth method, such as a vacuum evaporation method, a sputtering method, a CVD method, a laser vapor deposition method, and a cluster ion beam method. Further, after the metal layer is deposited, thermal processing may be performed on the metal layer 20*m* to cause the metal, as the composition metal of the metal layer 20*m*, to cohere in particle form by thermal process. Alternatively, a method, such as a method utilizing metal colloids, an LB method, a silane-coupling method, an oblique vapor deposition method, a vapor deposition method using a mask, and a method by natural evaporation after substituting CTAB for citric acid ("Nanosphere Arrays with Controlled Sub-10-nm Gaps as Surface-Enhanced Raman Spectroscopy Substrates", H. Wang et al., J. Am. Chem. Soc., Vol. 127, pp. 14992-14993, 2005), may be used (the method is described in detail in the third embodiment).

The method for fixing the initiator I is similar to the first embodiment.

In the present embodiment, in a manner similar to the first embodiment, the device includes micro-structure 30*d* including the plurality of metal bodies 20 on a surface of the substrate 10'. The plurality of metal bodies 20 have sizes that can excite localized plasmons by irradiation with the measurement light L1. Further, the device includes the initiator I fixed at least to a part of the surface 30*s* of the micro-structure 30*d*. Therefore, it is possible to achieve an action and effect similar to the first embodiment.

Figure 7:
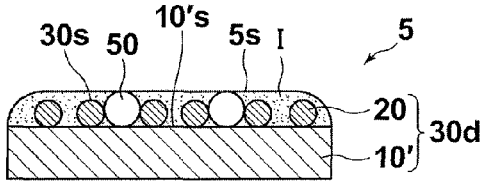
FIG. 7 is a sectional view of a device for mass spectrometry according to another example of the fourth embodiment of the present invention in the thickness direction of the device.

In the device 4 for mass spectrometry, if a plurality of dielectric particles 50 are further provided on the substrate 10' as illustrated in FIG. 7, it is possible to increase the ratio of isolating the micro metal bodies 20. Therefore, it is possible to localize heat on the sample-contact surface 5*s* at the time of measurement. When the heat is localized, the thermal energy is concentrated in the localized portion, compared with a case in which the heat is not localized. Therefore, it is possible to increase the efficiency of ionization. The sizes of the dielectric particles 50 are not particularly limited. However, it is desirable that the sizes of the dielectric particles 50 are at least twice the sizes (diameters) of the micro metal bodies 20 to effectively localize the heat. Optionally, the sizes of the dielectric particles 50 may be 100 nm or greater for example.

Further, when the solution containing the micro metal bodies 20 is used to fix the micro metal bodies 20 to the substrate 10', the dielectric particles 50 may be mixed to the solution and applied to the substrate 10' together with the micro metal bodies 20. If the dielectric particles 50 are applied in such a manner, it is possible to prevent (suppress) the micro metal bodies 20 next to each other from cohering to each other when the solution is dried after application.

(Design Modification)

In the first through third embodiments, the metal bodies 20 were formed by using, as a dielectric 11, an alumina layer obtained by anodically oxidizing a part of the metal body 40 to be anodically oxidized and by using, as an electroconductor 12, a non-anodically-oxidized portion and by causing metal to precipitate in the micro pores 11*a* of the dielectric 11 by electroplating. Alternatively, the whole metal body 40 to be anodically oxidized may be oxidized, and the electroconductor 12 may additionally be deposited by vapor deposition or the like. In this case, the material of the electroconductor 12 is not limited, and an electroconductive material, such as an arbitrary metal and ITO (indium-tin oxide), may be used.

In the above descriptions, only Al was mentioned as an example of the main component of the metal body 40 to be anodically oxidized. However, an arbitrary metal may be used as long as the metal can be anodically oxidized and a metal oxide object obtained by anodic oxidization transmits light. Examples of the metal other than Al are Si, Ti, Ta, Hf, Zr, In, Zn and the like. The metal body 40 to be anodically oxidized may contain at least two kinds of metals that can be anodically oxidized. The plane pattern of micro pores 11*a* formed in the metal body to be anodically oxidized differs according to the kind of the metal. Regardless of the kind of the metal, the dielectric 11 having structure in which micro pores 11*a* that have substantially the same form when viewed in plane view direction are arranged next to each other is formed by anodic oxidization.

So far, a case in which the micro pores 11*a* are regularly arranged by using anodic oxidization has been described. However, the method for forming the micro pores 11*a* is not limited to anodic oxidization. Anodic oxidization is desirable, because the entire surface can be processed at the same time, and large area processing is possible, and an expensive apparatus is not necessary. Besides the anodic oxidization, micro processing techniques, such as forming a plurality of regularly arranged depressions by performing nanoimprinting on the surface of a substrate made of a resin or the like, and drawing a plurality of regularly arranged depressions on the surface of a substrate, such as metal, by using an electronic drawing technique using a focused ion beam (FIB), an electron beam (EB) or the like, may be used. The micro pores 11*a* may be regularly arranged. However, it is not necessary that the micro pores 11*a* are regularly arranged.

Further, in the above descriptions, a case in which the electroconductor 12 is provided on the back side 11*r* of the dielectric 11 was described. However, when a method that needs electrodes for electroplating is not used as the method for loading the metal bodies 20 in the micro pores 11*a*, it is not necessary that the electroconductor 12 is provided. Alternatively, the electroconductor 12 may be removed after formation of the metal bodies 20.

"Mass Spectrometry Apparatus"

Figure 8:
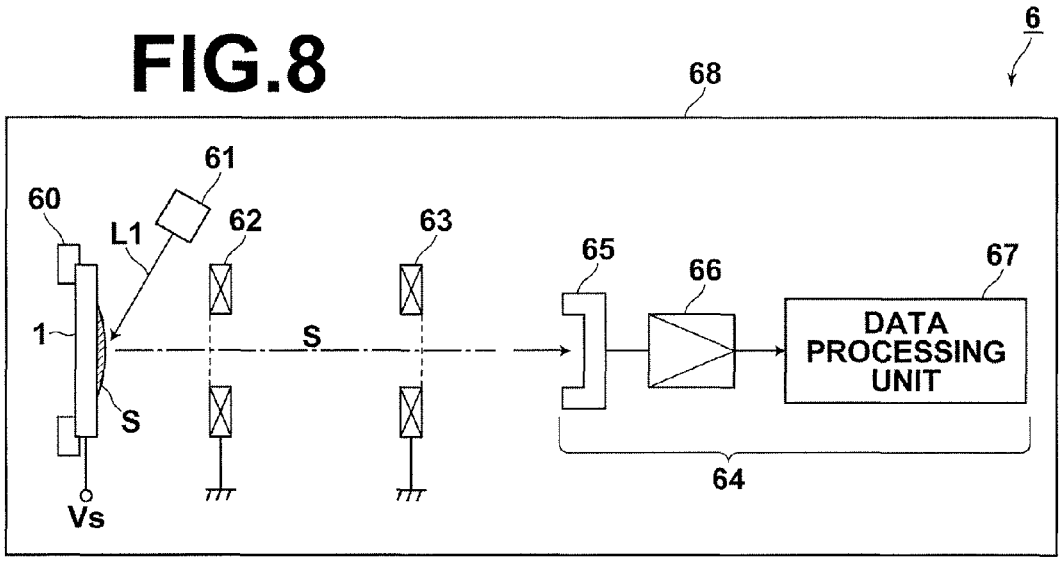
FIG. 8 is a schematic diagram illustrating the structure of a mass spectrometry apparatus according to an embodiment of the present invention.

With reference to FIG. 8, a mass spectrometry apparatus according to the first embodiment of the present invention will be described as a case of using the device 1 for mass spectrometry according to the first embodiment. The mass spectrometry apparatus of the present embodiment is a mass spectrometry apparatus of time-of-flight type (TOF-MS). FIG. 8 is a schematic diagram illustrating the configuration of a mass spectrometry apparatus 6 of the present embodiment. When the devices 2 through 5 for mass spectrometry of the second through fourth embodiments are used, the configuration of the apparatus is similar to the configuration of the apparatus using the device 1 for mass spectrometry, and similar advantageous effects are obtained.

As illustrated in FIG. 8, the mass spectrometry apparatus 6 includes the device 1 for mass spectrometry of the aforementioned embodiment, a device holding means 60, a first light irradiation means 61, and an analysis means 64 in a box 68 the inside of which is kept in a vacuum state. The device holding means 60 holds the device 1 for mass spectrometry. The first light irradiation means 61 irradiates a sample in contact with the surface 1*s* of the device 1 for mass spectrometry with measurement light L1 to desorb analyte S of mass spectrometry contained in the sample from the surface 1*s*. The analysis means 64 detects the desorbed analyte S and analyzes the mass of the analyte S. Further, the mass spectrometry apparatus 6 includes an extraction grid 62 and an end plate 63. The extraction grid 62 is arranged between the device 1 for mass spectrometry and the analysis means 64 in such a manner to face the surface 1*s*. The end plate 63 is arranged in such a manner to face a surface of the extraction grid 62, the surface being opposite a surface of the extraction grid 62 facing the device 1 for mass spectrometry.

The first light irradiation means 61 may include a single wavelength light source, such as laser. Further, the first light irradiation means 61 may include a light guide system, such as a mirror, for guiding the light output from the light source. The single wavelength light source is, for example, a pulse laser with wavelength of 337 nm and a pulse width of approximately 50 ps to 50 ns, or the like.

The analysis means 64 substantially includes a detection unit (detector) 65, an amplifier 66 and a data processing unit 67. The detection unit 65 detects the analyte S that has been desorbed from the surface of the device 1 for mass spectrometry by irradiation with the measurement light L1 and flown through the extraction grid 62 and a hole at the center of the end plate 63. The amplifier 66 amplifies an output from the detection unit 65. The data processing unit 67 processes an output signal from the amplifier 66.

Next, mass spectrometry using the mass spectrometry apparatus 6 as described above will be described.

First, voltage Vs is applied to the device 1 for mass spectrometry in contact with a sample. Further, the light irradiation means 61 outputs measurement light L1 having a specific wavelength based on a predetermined start signal, and the surface is of the device 1 for mass spectrometry is irradiated with the measurement light L1. When the surface is is irradiated with the measurement light L1, an electric field on the surface 1*s* of the device 1 for mass spectrometry is enhanced, and the measurement light L1 is enhanced by the enhanced electric field. Accordingly, the light energy of the measurement light L1 is enhanced, and the initiator is excited. Accordingly, the analyte S contained in the sample is ionized from the surface 1*s*, and desorbed from the surface 1*s*.

The desorbed analyte S is drawn to the direction of the extraction grid 62 by a potential difference between the device 1 for mass spectrometry and the extraction grid 62, and accelerated. Further, the analyte S flies substantially straight to the direction of the end plate 63 through the hole at the center. Further, analyte S flies through the hole of the end plate 63, and reaches the detection unit 65 to be detected.

Further, another substance, such as a part of surface modification in the device 1 for mass spectrometry, may be bound to the analyte S. After desorption, the speed of flight of the analyte S depends on the mass of the substance. The speed of flight is higher as the mass is smaller. Therefore, substances are sequentially detected by the detection unit 65 in an ascending order of the mass, in other words, a low-mass substance is detected first.

An output signal from the detection unit 65 is amplified by the amplifier 66 to a predetermined level, and input to the data processing unit 67. Since the data processing unit 67 has received a synchronous signal that synchronizes with the start signal, the data processing unit 67 can obtain, based on the synchronous signal and the output signal from the amplifier 66, the flight time of the analyte S. Therefore, it is possible to obtain the mass of the analyte S based on the flight time, and to obtain the mass spectrum of the analyte S.

The mass spectrometry apparatus 6 of the present embodiment uses the device 1 for mass spectrometry of the aforementioned embodiment. Therefore, the mass spectrometry apparatus 6 can achieve an advantageous effect similar to the device 1 for mass spectrometry.

In the present embodiment, a case in which all the elements (devices) are provided in the box 68 has been described. However, it is sufficient if at least the device 1 for mass spectrometry, the extraction grid 62, the end plate 63 and the detection unit 65 are placed in the box 68.

In the present embodiment, a case in which the mass spectrometry apparatus 6 is a TOF-MS has been described. However, it is not necessary that the mass spectrometry apparatus 6 is TOF-MS, and the mass spectrometry apparatus 6 may be applied to other kinds of mass spectrometry methods.

EXAMPLES

Next, examples of the present invention will be described.

Example 1

The micro-structure 1 according to the first embodiment was produced through the following procedures.

An aluminum plate (Al purity is 99.99%, and the thickness of the plate is 10 mm) was prepared as a metal body to be anodically oxidized, and used as an anode. Further, a cathode made of aluminum was used, and anodic oxidization was performed under conditions that a part of the aluminum plate became an alumina layer (aluminum oxide layer) to produce a micro pore substrate. The average diameter of the micro pores in the obtained substrate was 50 nm, and the average pitch P of the micro pores was approximately 100 nm. During the anodic oxidization, the temperature of the liquid was 15° C., and the other conditions were set in the following manner.

Reaction Conditions:

electrolyte solution of 0.5 M oxalic acid;

applied voltage at 40V; and reaction time of 5 hours.

Next, a non-anodically-oxidized portion of the metal body was used as an electrode, and Au plating was performed on the micro pores from the bottoms of the micro pores till the plating material (Au) overflowed from the micro pores to the surface of the substrate. Accordingly, mushroom-shaped micro metal structures with stem portions (stipe portions) filling the micro pores were formed. At this time, the time period of plating was adjusted to make the head portions (cap portions or pileus portions) of the mushroom-shaped metal bodies apart from each other by approximately 10 nm.

Next, a bis(tridecafluoro-tetrahydrooctyl)tetramethyldisiloxane solution was prepared as an initiator. Further, the initiator was fixed onto the surface of the micro-structures to obtain the device for mass spectrometry according to the present invention. The initiator was fixed by applying the initiator to the surface, drying the applied initiator and removing excessive initiator. The application, drying and removal processes were repeated a few times to fix the initiator. The drying process was performed by thermal processing by heating the initiator in an oven at 120 degrees for 50 seconds. Further, the excessive initiator was removed by a nitrogen gun.

Further, mass spectrometry was performed by using the obtained device for mass spectrometry of the present invention and a device for comparison. As the device for comparison, a device for mass spectrometry before the initiator was fixed onto the micro-structure was used. The mass spectrometry was performed by using Autoflex™ III, mass spectrometry apparatus produced by Bruker Daltonics Inc. The measurement sample and the measurement conditions were as follows:

analyte: Angiotensin I, produced by SIGMA-ALDRICH Corp.;

density of sample: 1 μM;

drop amount of sample: 0.5 μL;

wavelength of measurement light: 355 nm; and measurement mode: positive ion mode.

Figure 9:
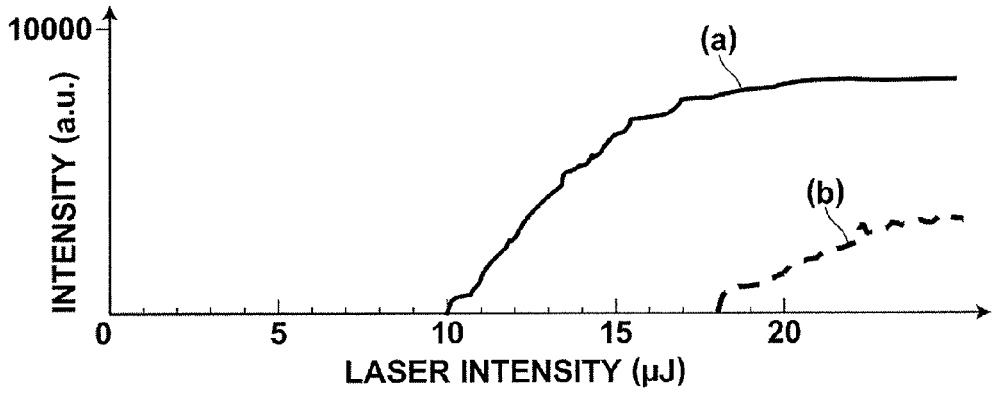
FIG. 9 is a graph showing the relationship between the intensity of measurement light and the intensity of signal light in Example 1.

FIG. 9 is a graph showing the detected ion strength (intensity or strength of signal light) with respect to the intensity of laser, which is the measurement light. In FIG. 9, line (a) shows the result of measurement by the device for mass spectrometry according to the present invention, and line (b) shows the result of measurement by the device for comparison, in which the initiator was not fixed to the surface. FIG. 9 confirmed that in the line (b) (without initiator), ions were first detected when the intensity of the laser reached 18 μJ, and that in line (a) (with initiator), ions began to be detected when the intensity of the laser was approximately at 10 μJ, which is a low power range. Further, FIG. 9 shows that the absolute value (absolute amount) of the intensity of signal light in line (a), in which the device for mass spectrometry according to the present invention was used, was remarkably higher than the absolute value of the intensity of signal light in line (b), in which the device for comparison was used.

Figure 10A:
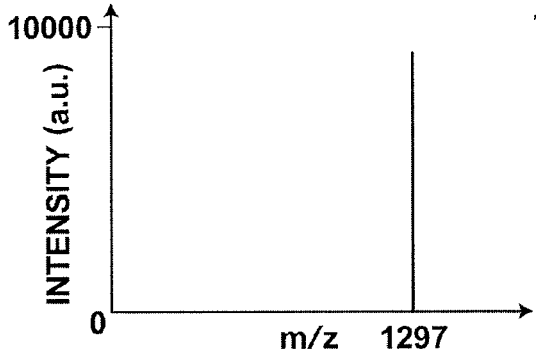
FIG. 10A is a diagram illustrating a mass spectrum when the device for mass spectrometry according to the present invention is used in Example 1.
Figure 10B:
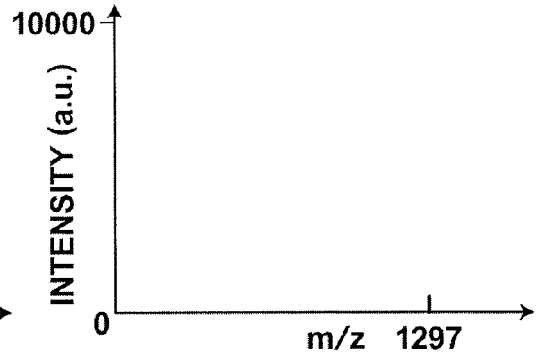
FIG. 10B is a diagram illustrating a mass spectrum when a device for mass spectrometry for comparison is used.

Further, FIGS. 10A and 10B show mass spectra corresponding to lines (a) and (b) in FIG. 9, respectively, when the intensity of the laser light of measurement light was 20 μJ. FIGS. 10A and 10B also confirmed that the absolute value of the intensity of signal light in line (a), in which the device for mass spectrometry according to the present invention was used, was remarkably higher than the absolute value of the intensity of signal light in line (b). Therefore, in the device for mass spectrometry according to the present invention, high sensitivity measurement using a low power light source is possible.

The present invention may be applied to mass spectrometry apparatuses that are used to identify substance or the like.

What is claimed is:

1. A device for mass spectrometry, wherein a sample in contact with a surface of the device is irradiated with measurement light to desorb an analyte contained in the sample from the surface of the device, the device comprising:

a micro-structure including a substrate and a plurality of metal bodies on a surface of the substrate, the plurality of metal bodies having sizes that can excite localized plasmons by irradiation with the measurement light; and an initiator fixed at least to a part of a surface of the micro-structure, wherein the micro-structure further includes a plurality of dielectric particles on the surface thereof.

2. A device for mass spectrometry, as defined in claim 1, wherein in the micro-structure, the substrate includes a dielectric having a plurality of micro-pores that have openings on the surface of the substrate and bottoms, and wherein the plurality of metal bodies are fixed at least to a part of the bottoms of the plurality of micro-pores and/or at least to a part of a non-opening portion of the surface of the substrate, in which the micro-pores are not present.

3. A device for mass spectrometry, as defined in claim 1, wherein in the micro-structure, the substrate includes a dielectric having a plurality of micro-pores that have openings on the surface of the substrate and bottoms, and wherein the plurality of metal bodies include filling portions that fill the insides of the plurality of micro-pores and projection portions that are formed on the filling projections in such a manner to project from the surface of the substrate, the maximum diameters of the projection portions in a direction parallel to the surface of the substrate being greater than the diameters of the filling portions, and wherein at least a part of the projection portions of the plurality of metal bodies are apart from each other.

4. A device for mass spectrometry, as defined in claim 3, wherein an average distance between the projection portions that are next to each other is 10 nm or less.

5. A device for mass spectrometry, as defined in claim 2, wherein the distribution of the plurality of micro-pores are substantially regular.

6. A device for mass spectrometry, as defined in claim 5, wherein the dielectric is made of a metal oxide object obtained by anodically oxidizing a part of a metal body to be anodically oxidized, and wherein the plurality of micro-pores were formed in the metal oxide object during the process of anodically oxidizing the part of the metal body to be anodically oxidized.

7. A device for mass spectrometry, as defined in claim 1, wherein the initiator is an organic silicon compound.

8. A mass spectrometry apparatus comprising:

a device for mass spectrometry as defined in claim 1;

a light irradiation means that irradiates the sample in contact with a surface of the device for mass spectrometry, the surface on which the initiator has been fixed, to desorb the analyte of mass spectrometry contained in the sample from the surface of the device for mass spectrometry; and an analysis means that analyzes the mass of the analyte by detecting the desorbed analyte.

9. A mass spectrometry apparatus, as defined in claim 8, wherein the apparatus is a time-of-flight mass spectrometry apparatus.

10. A device for mass spectrometry as defined in claim 1, wherein the average particle size of the plurality of dielectric particles is two times or greater than the average particle size of the metal bodies.

11. A device for mass spectrometry as defined in claim 1, wherein the average particle size of the plurality of dielectric particles is 100 nm or greater.

12. A mass spectrometry method using a device for mass spectrometry, wherein a sample in contact with a surface of the device is irradiated with measurement light to desorb an analyte contained in the sample from the surface of the device, the device comprising a micro-structure including a substrate and a plurality of metal bodies on a surface of the substrate, the plurality of metal bodies having sizes that can excite localized plasmons by irradiation with the measurement light; and an initiator fixed at least to a part of a surface of the micro-structure, the method comprising the steps of:

making the sample in contact with a surface of the device for mass spectrometry, the surface on which the initiator has been fixed;

irradiating the sample in contact with the surface with measurement light;

enhancing the effect of the initiator by a localized plasmon enhanced electric field generated in the plurality of metal bodies by irradiation with the measurement light and by the measurement light enhanced in the localized plasmon enhanced electric field to desorb the analyte contained in the sample from the surface of the device for mass spectrometry; and performing mass spectrometry by capturing the analyte desorbed from the surface.

* * * * *